United States Patent [19]

Senee

[11] Patent Number: 4,903,417

[45] Date of Patent: Feb. 27, 1990

[54] APLINE SKI BOOT HAVING AN UPPER PARTIALLY OR TOTALLY JOURNALLED ON A SHELL BASE

[75] Inventor: Olivier Senee, Annecy, France

[73] Assignee: Salomon, S.A., Annecy, France

[21] Appl. No.: 209,316

[22] Filed: Jun. 21, 1988

[30] Foreign Application Priority Data

Jun. 29, 1987 [FR] France ..... 87 09133

[51] Int. Cl.[4] ..... A43B 5/04; A43B 23/26; A43B 23/02

[52] U.S. Cl. ..... 36/117; 36/54; 36/121

[58] Field of Search ..... 36/117–121, 36/54

[56] References Cited

U.S. PATENT DOCUMENTS

| | | | |
|---|---|---|---|
| 3,657,827 | 4/1972 | Rieker | 36/117 X |
| 4,470,206 | 9/1984 | Annovi | 36/121 |
| 4,669,202 | 6/1987 | Ottieri | 36/120 |
| 4,677,771 | 7/1987 | Arieh et al. | 36/120 |
| 4,712,315 | 12/1987 | Morell et al. | 36/117 |

FOREIGN PATENT DOCUMENTS

| | | |
|---|---|---|
| 0053339 | 6/1982 | European Pat. Off. . |
| 0135184 | 3/1985 | European Pat. Off. . |
| 0172156 | 2/1986 | European Pat. Off. . |
| 2073201 | 9/1971 | France . |
| 2096248 | 2/1972 | France . |
| 2416661 | 9/1979 | France . |

*Primary Examiner*—James Kee Chi

*Attorney, Agent, or Firm*—Sandler & Greenblum

[57] ABSTRACT

An alpine ski boot has an cuff mounted on a shell base for forward and rearward pivotal movement about a transverse axis. An element is mounted on the cuff in frictional engagement with an element mounted on the shell base so that the elements move relative to each other in response to pivotal movement of the cuff relative to the shell base. Control means, in association with the elements, are responsive to relative movement between the engaged elements such that the force required to move the elements relative to each other is dependent on the direction of pivotal movement of the cuff relative to the shell base.

69 Claims, 8 Drawing Sheets

APLINE SKI BOOT HAVING AN UPPER PARTIALLY OR TOTALLY JOURNALLED ON A SHELL BASE

BACKGROUND OF THE INVENTION

1. Field of Invention

The present invention relates to an alpine ski boot having a cuff pivotally mounted on a shell base for rotation about a lower transverse axis substantially coincident with the ankle of the wearer of the boot.

2. Description of Background and Relevant Information

Alpine ski boots often incorporate shock absorption apparatus for controlling flexional forces transmitted by the skier during anterior-posterior flexion of the cuff relative to the shell base of a boot. Conventional shock absorption apparatus for controlling such flexional forces can be classified into two separate groups. In one group are found shock absorbers which are responsive to forward movement of the cuff for returning the same to its initial position; and in this group are found apparatus described in French Patent No. 2,096,248 and European Patent No. 172,156. The shock absorption apparatus of this first group generally comprise an elastic element operative to oppose, with a predetermined force, flexional movement of the cuff on the shell base during forward leg movement, and which instantaneously restores the upper to its initial position as soon as the forward movement terminates. Such apparatus thus comprise an elastic suspension adapted to cushion only forward leg movements; and as a result, the "return" of the upper imposes a relatively severe stress on the leg of the skier. As a consequence, such apparatus is often poorly adapted to the needs of a skier; and moreover, such apparatus cannot be controlled by the skier and is not desired for this reason. In such apparatus, where the "return" occurs in response to relative movement of the cuff of the boot with respect to the shell base, the elastic element involved in the return is positioned between these two portions of the boot.

In a second group of shock absorption apparatus are found what is termed "double effect" shock absorption apparatus which produce a rearward return force which varies in accordance with the extent of forward flexional movement. Such apparatus is described in French Patent No. 2,073,201 and European Patent Application No. 53,339. "Double effect" shock absorption apparatus overcome the disadvantage of shock absorption apparatus of the first group, and particularly the severe "return" of the cuff to its initial position. In addition, "double effect" shock absorption apparatus avoid the floating sensation associated with apparatus of the first group which occurs on the termination of flexional bias on the cuff which occurs with apparatus in the first group. However, the shock absorption apparatus disclosed in the last mentioned documents utilize hydraulic fluids, and are thus both complicated and expensive to manufacture and maintain.

Another "double effect" shock absorption apparatus is described in European Patent No. 135,184. This apparatus comprises two engaged elements, one attached to the cuff and the other attached to the shell base so that relative movement occurs between the elements during displacement of the upper relative to the shell base. The contact pressure between the two elements is adjustable for controlling the coefficient of friction between the elements, and thus the resistance to relative movement.

Such shock absorption apparatus has the advantage of structural simplicity which produces manufacturing costs and weight. The disadvantage, however, is that the coefficient of friction between the two elements is the same in both directions of movement of the cuff on the shell base. Thus, the resistance which opposes forward flexional leg movement is the same as that which opposes the return movement of the cuff to its initial position. This equal resistance to movement in the two directions is disadvantageous in skiing.

It is therefore an object of the present invention to provide a new and improved alpine ski boot in which the disadvantages of the prior art described above are substantially reduced or overcome.

SUMMARY OF INVENTION

An alpine ski boot, according to the present invention, having an cuff mounted on a shell base for forward and rearward pivotal movement about a transverse axis includes an element mounted on the cuff and frictionally engaged with an element mounted on the shell base so that the elements move relative to each other in response to pivotal movement of the cuff relative to the shell base. Control means, operatively associated with the elements, are responsive to relative movement between the engaged elements such that the force required to move the elements relative to each other is dependent upon the direction of pivotal movement of the cuff relative to the shell base. Specifically, the control means is constructed and arranged so that the coefficient of friction between the elements is less during forward pivotal movement than during rearward pivotal movement of the cuff on the shell base.

The present invention therefore overcomes the disadvantages noted previously by providing an alpine ski boot with shock absorption apparatus that is particularly simple in design and which makes it possible to provide a different "stiffness" to pivotal movement of the cuff on the shell base depending upon the direction of relative displacement of the cuff.

BRIEF DESCRIPTION OF THE DRAWINGS

Nonlimiting examples of the various embodiments of the present invention are shown in accompanying drawings wherein.

DESCRIPTION OF PREFERRED EMBODIMENTS

Figure 1:
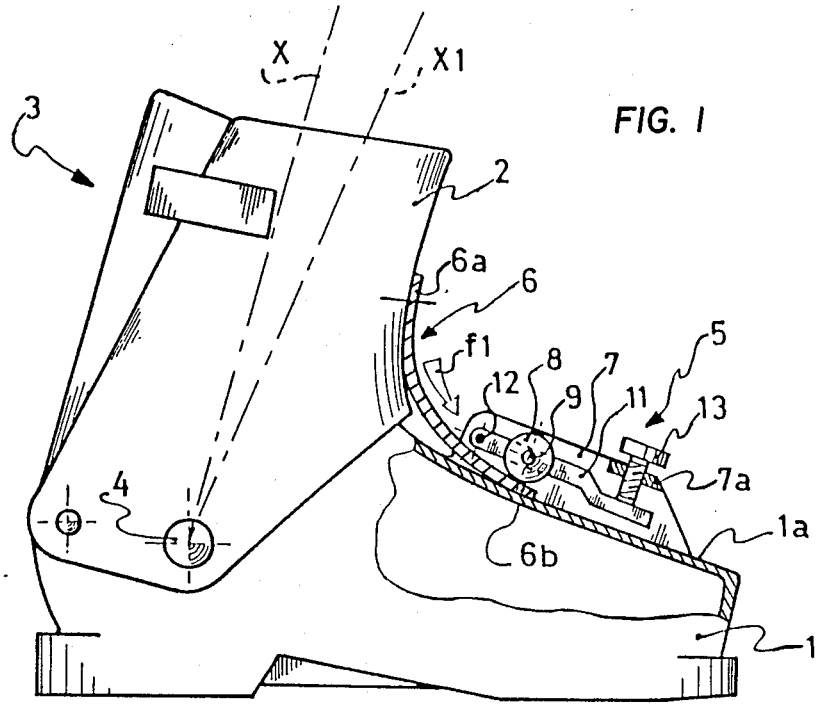
FIG. 1 is an elevation view of an alpine ski boot prior to forward flexion of the cuff from its initial position, and showing, in vertical cross-section, shock absorption apparatus according to the present invention.
Figure 3:
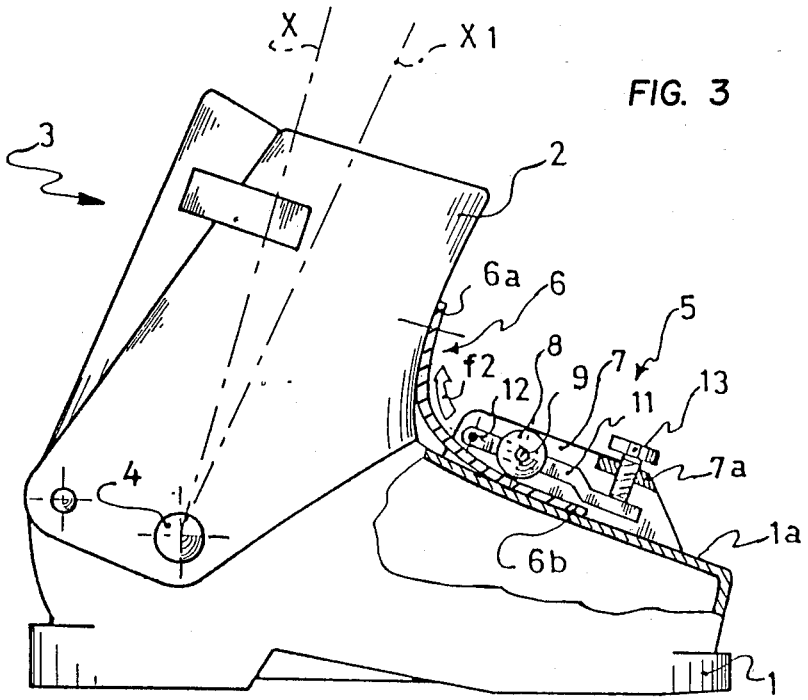
FIG. 3 is an elevation view, partly in cross-section, of the boot shown in FIG. 1, in the course of return movement of the cuff towards its initial position.
Figure 2:
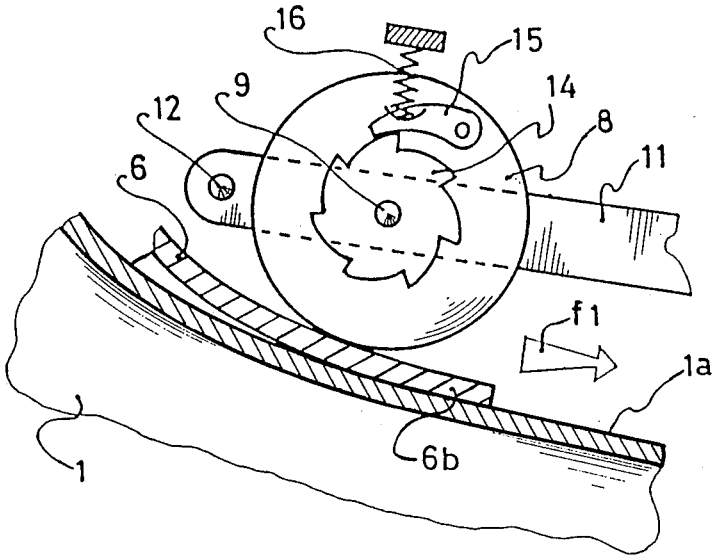
FIG. 2 is an enlarged vertical schematic cross-sectional view of the shock absorption apparatus of the present invention.
Figure 4:
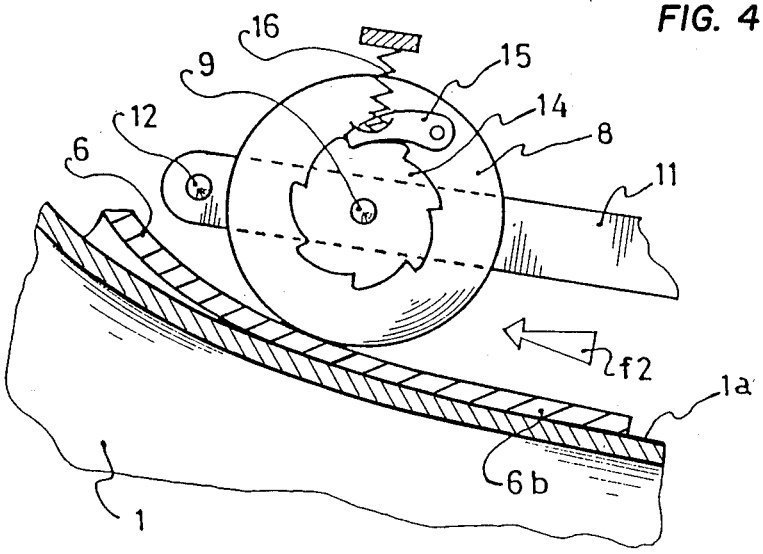
FIG. 4 is an enlarged vertical schematic cross-sectional view of shock absorption apparatus of the present invention showing the relative position of the components during return movement of the cuff towards its initial position.

Referring to FIGS. 1–4, the alpine ski boot shown therein comprises shell base 1 on which is journalled the front portion or cuff 2 of upper 3 of a boot. Cuff 2 is pivotally mounted on shell base 1 for pivotal movement about lower transverse axis 4 that is located substantially at the level of, and coincident with, the ankle of the skier wearing the boot.

The boot is provided with shock absorption apparatus 5 mounted on upper surface 1*a* of shell base 1 which is inclined from top to bottom and rear to front. Apparatus 5 is constructed and arranged to resist forward movement of cuff 2 from an initial position, shown by axis X, to a forward position shown by axis X1 during anterior-posterior flexion of the leg of the skier. Apparatus 5 also resists rearward movement of the cuff from its forward position to its initial position. As explained in detail below, apparatus 5 constitutes control means responsive to relative movement between the engaged elements such that the force required to move the elements relative to each other is dependent on the direction of pivotal movement of the upper relative to the base.

In the embodiment of the invention shown in FIGS. 1–4, shock absorption apparatus 5 comprises a movable element constituted by flexible blade 6 fixed at its rear upper end 6*a* to the front portion of cuff 2. The front and lower end 6*b* of the blade slides freely on upper surface 1*a* of shell base 1 which thus forms a support surface for the flexible blade which is curved so as to present an upwardly and frontwardly directed concavity. Apparatus 5 further comprises a fixed element constituted by support housing 7 mounted on surface 1*a* of shell base 1 and which contains pressure roller 8 rotatably mounted around a horizontally disposed axel 9 that is transverse to the direction of movement of the blade. The periphery of pressure roller 8 is spaced from support surface 1*a* of shell base 1 for defining a narrow passage or space which is just sufficient to slideably receive flexible blade 6. The lower surface of the blade frictionally engages upper surface 1*a;* and the upper surface contacts pressure roller 8.

Axel 9 of pressure roller 8 is carried by lever 11 which is itself pivotably mounted, at its rear end, on housing 7 for pivotal rotation about horizontal axis 12 that is transverse to the direction of movement of the blade. The free end of lever 11 contacts the free end of pressure adjustment screw 13 which is threaded into portion 7*a* of housing 7. By rotating adjustment screw 13, which is engaged with the free end of lever 11, the spacing between the pressure roller and the upper surface 1*a* of shell base 1 can be adjusted. When the blade is in place, the contact pressure exerted by pressure roller 8 on flexible blade 6 can be adjusted so to increase or decrease the normal force between the pressure roller and the blade thus controlling the coefficient of friction between the blade and the upper surface of the shell base and between the blade and the roller.

Apparatus 5 is provided with means for effecting rotation of pressure roller 8 only in one direction of movement of the blade relative to the roller, i.e., in the counterclockwise direction in the drawing. Means allowing for only unidirectional rotation of pressure roller 8 can be constituted, for example, by toothed ratchet wheel 14 (FIGS. 2 and 4) affixed to roller 8, and by pawl 15 mounted on lever 11, and urged by spring 16 into contact with the teeth of ratchet wheel 14. Lever 15, together with ratchet wheel 14 and cooperating pawl 15, effect rotation of pressure roller 8 in the counterclockwise direction, and constrain the roller against rotation in the reverse direction.

During forward flexion of cuff 2 from its initial position X to its flexed position X1, flexible blade 6 is forwardly displaced in the direction of arrow f1 and slides on upper surface 1*a* of shell base 1. In the course of this forward movement of the cuff, the contact between flexible blade 6 and pressure roller 8 is such as to rotate the roller in a counterclockwise direction. This rolling friction between the roller and the blade offers little resistance to the forward movement of the blade in response to forward movement of the cuff. Stated otherwise, the coefficient of friction of shock absorption apparatus 5 during forward movement of the cuff is small; and consequently, the "hardness" of such movement is low.

On the contrary, during return movement of cuff 2 from its forward position X1 to its initial position X (FIG. 3), flexible blade 6 moves rearwardly in the direction of arrow f2. During this rearward sliding movement of the blade on the upper surface 1*a* of shell base 1, flexible blade 6 tends to rotate roller 8 clockwise as a result of the contact of the upper surface of the blade with the roller. However, clockwise rotation of the roller is constrained by the engagement of pawl 15 against a tooth of ratchet wheel 14. Rotation of pressure roller 8 is thus prevented as flexible blade 6 is constrained to slide against the periphery of the pressure roller. The resultant sliding friction produced during rearward return of cuff 2 exceeds the rolling friction produced during forward movement of the cuff. Stated otherwise, shock absorption apparatus 5 produces a greater coefficient of friction during rearward displacement of the cuff than during forward displacement. As a result, the "hardness" of cuff movement is greater during return movement of the cuff towards its initial position X than during forward movement.

Figure 5:
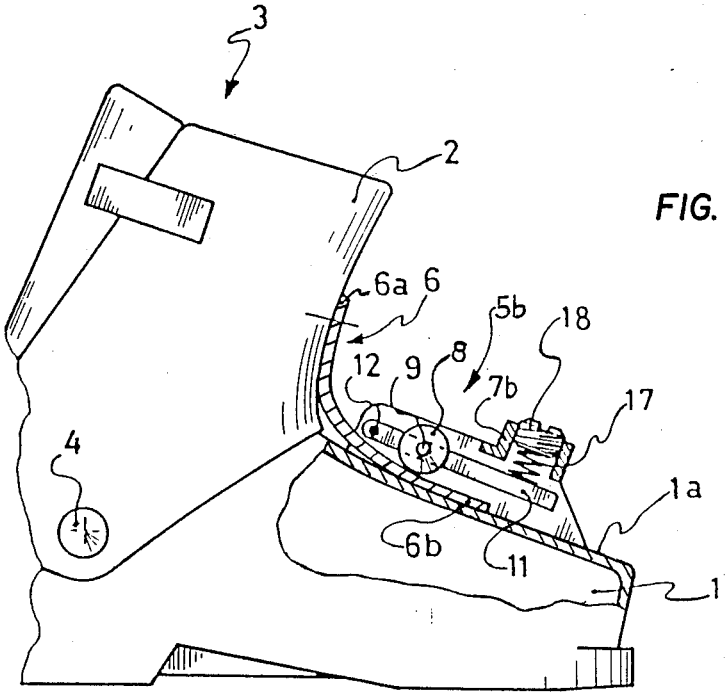
FIG. 5 is an elevation view, partly in cross-section, of a boot provided with an alternative embodiment of a shock absorber according to the present invention.

Pressure roller 8 of apparatus 5, itself, can be made from a more or less elastically compressible material. In the embodiment of the invention shown in FIG. 5, pressure roller 8 is formed of a relatively rigid material and the free end of lever 11 is subjected to the action of compression spring 17 supported on pressure adjustment screw 18 threaded in a tapped hole in the upper portion of housing 7.

Figure 7:
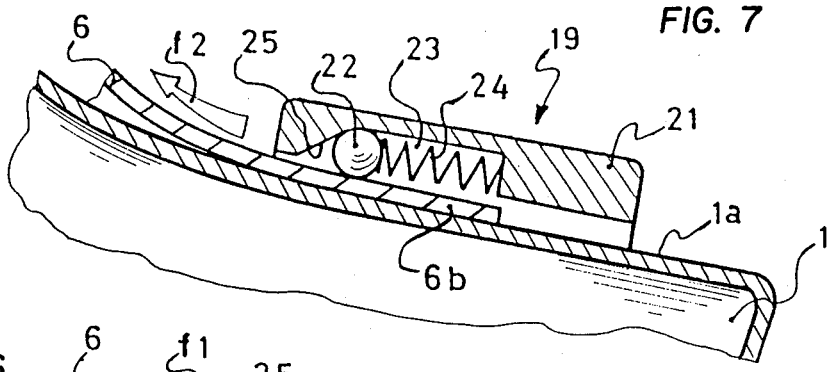
FIGS. 6 and 7 are schematic cross-sectional views of a further embodiment of the shock absorption apparatus according to the present invention mounted on an alpine ski boot.
Figure 6:
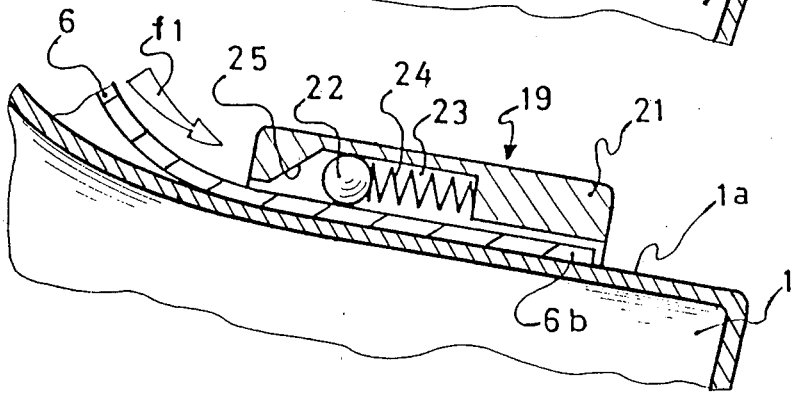

In the embodiment of the invention shown in FIGS. 6 and 7, shock absorption apparatus 19 comprises a housing mounted on upper surface 1*a* of shell base and having a slot for freely receiving front lower end portion 6*b* of flexible plate 6. Portion 6*b* slides between upper surface 1*a* of shell base 1 and transverse pinch-roller 22 mounted in longitudinal slot 23 in the housing for translation in the longitudinal direction. Compression spring 24, interposed between the housing and the pinch-roller 22, urges the latter toward ramp 25 that defines the rear end of opening 23. Ramp 25 is inclined, from top to bottom, and from and front to rear. Stated otherwise, spring 24 normally urges pinch-roller 22 into a pinch-position between ramp 25 and the upper surface of end portion 6*b* of flexible blade 6. The contact pressure between the pinch-roller and the block is dependent on the strength of spring 24.

When flexible blade 6 is forwardly displaced in the direction of arrow f1 (FIG. 6) in response to forward flexion of the cuff. end portion 6*b* of flexible blade 6 slides freely in the slot in housing 21 towards the front of container 21 by pushing against spring 24 and slightly moving roller 22 forwardly away from ramp 25. This results in suppression of the pinching effect of roller 22 on the blade. In this case the resistance to forward movement of the cuff is due only to the friction of flexible blade 6 on upper surface 1*a* of shell base 1 and the rolling contact of the upper surface of the blade with roller 22. The overall coefficient of friction of shock absorption apparatus 19, or its "hardness", during forward movement of the cuff is thus relatively weak.

On the contrary, when flexible blade 6 is rearwardly displaced, compression spring 24 pushes roller 22 against pinching ramp 25 whose inclination causes the roller to exert a predetermined contact pressure on the upper surface of flexible blade 6. Such pressure contributes to substantially increasing the overall coefficient of friction produced by shock absorption apparatus 19 in response to return movement of the cuff in the rearward direction.

Figure 8:
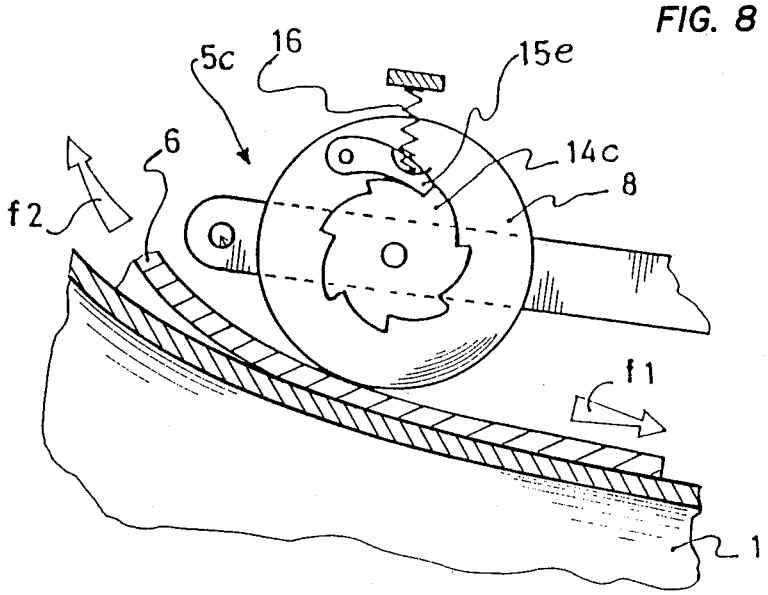
FIGS. 8 and 9 are schematic cross-sectional views of shock absorption apparatus of the same type shown in FIGS. 1–7, but showing a reversal in the direction of operation.
Figure 9:
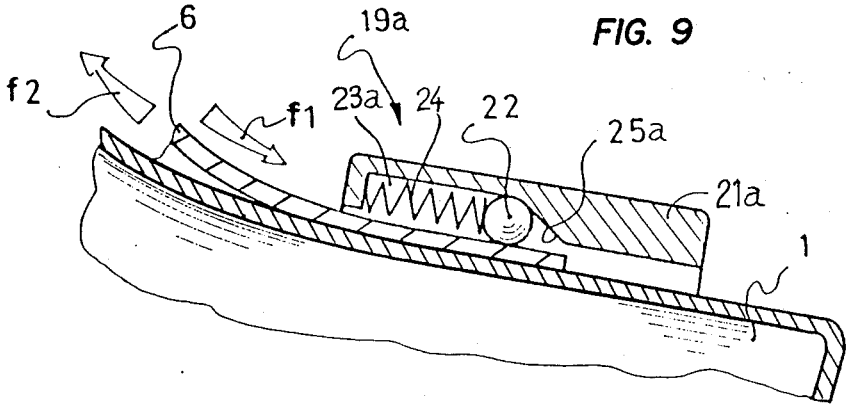

The invention is likewise capable of operating oppositely to that previously described. That is to say, shock absorption apparatus 5A and 19A (FIGS. 8 and 9) are designed to offer maximum of resistance during frontward flexion, rather than rearward flexion, of cuff 2 of upper 3, i.e., in the direction of arrow f1. To this end, ratchet wheel 14C and pawl 15C of apparatus 5C (FIG. 8) are mounted in reverse manner from the mounting of corresponding parts in the embodiment of FIGS. 1–4. In this manner, roller 8 is constrained against rotation in the clockwise direction.

Similarly, pinch-wheel 22 and ramp 25A in apparatus 19A are positioned to produce more resistance for movement of blade 6 in the direction of arrow f1 than in the direction of arrow f2. In this respect, the embodiment of FIG. 9 operates in an opposite manner from the operation of the embodiment of FIGS. 6 and 7. To achieve this result, ramp 25 is located at the front of space 23A in housing 21A. In addition, ramp.25A is inclined from top to bottom, and from rear to front, as spring 24 urges roller 22 forwardly towards the ramp.

Figure 10:
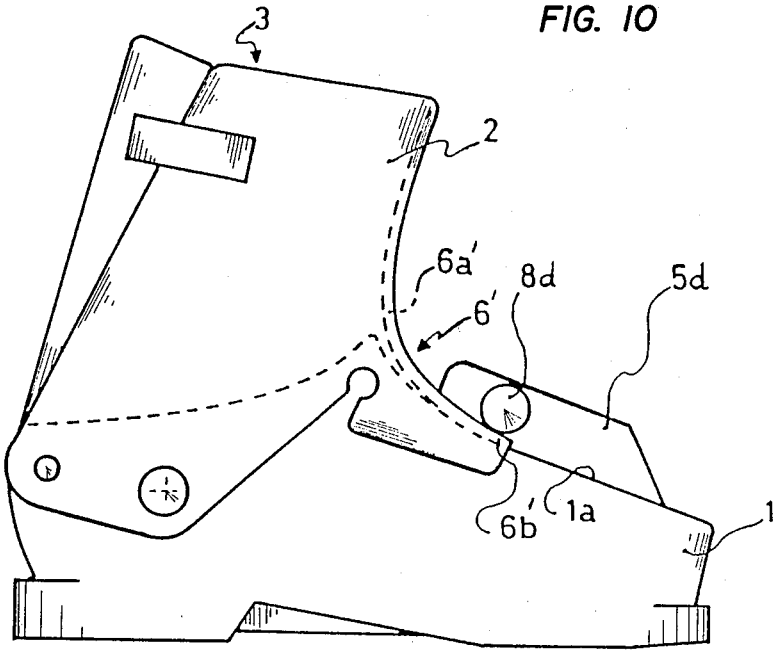
FIGS. 10 and 11 are elevation views, partly in cross-section, of an alpine ski boot with a still further embodiment of shock absorption apparatus according to the invention.

Also included within the scope of the present invention, is a modification in which the flexible blade is integral with the portion of the boot to which it must be attached. Thus, as shown in FIG. 10, the flexible blade 6' is molded of a single piece with the front portion of cuff 2 so that the rear and upper end 6*a'* is an integral part of the cuff. In this case, as in the embodiments previously described, the front and lower end 6*b'* of the blade slides on upper surface 1*a* of shell base 2. The modification is applicable to the embodiment of shock absorption apparatus like that shown in FIGS. 1–5 as well as the apparatus shown in FIGS. 6, 7 and 9.

Figure 11:
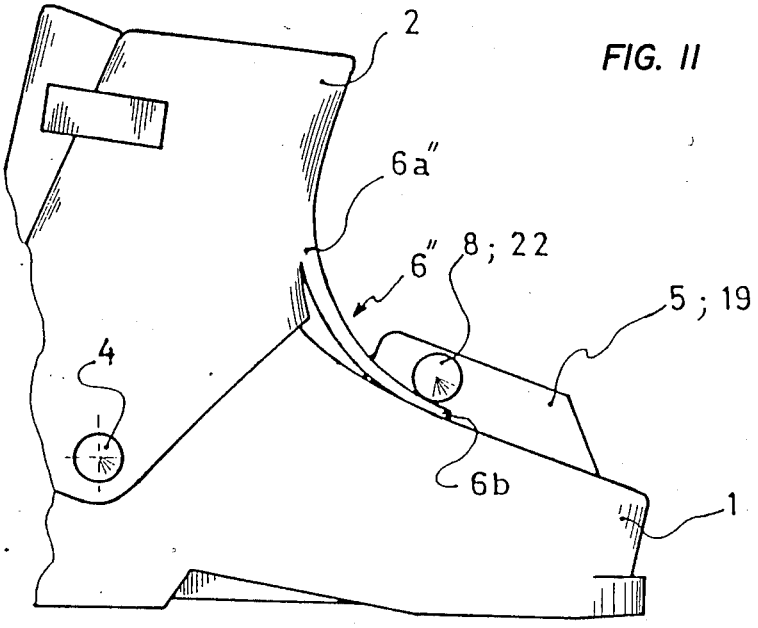

FIG. 11 shows a modification in which flexible blade 6'' has a variable thickness along its length. In the case shown, flexible blade 6 is formed with a thickness or cross-section which progressively decreases from its rear and upper end 6*a''* toward until its front and lower end 6*b''*. This arrangement, for a given material of the cuff, permits dynamic changing, in a progressive manner, of the coefficient of friction in response to flexional movement of the cuff. Alternatively, variation in thickness of the blade may be reversed from that which has just been described. Also include within the scope of the invention is an arrangement in which the thickness varies with length in a non-monotonic manner. These modifications are applicable to the embodiment of shock absorption apparatus like that shown in FIGS. 1–5 as well as the apparatus shown in FIGS. 6, 7 and 9.

Figure 12:
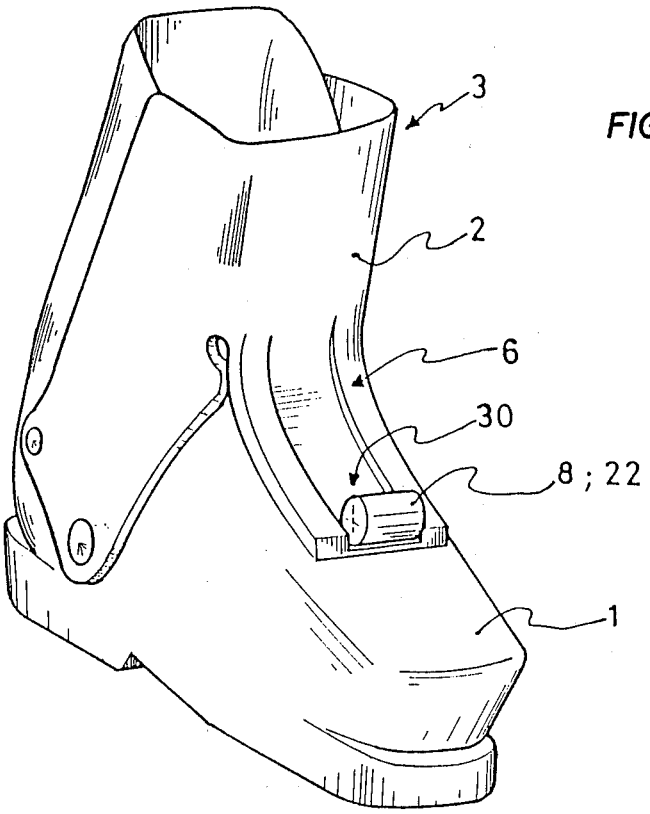
FIG. 12 is a perspective view of the ski boot showing a modification of the construction of the elements of shock absorption apparatus according to the present invention.
Figure 13:
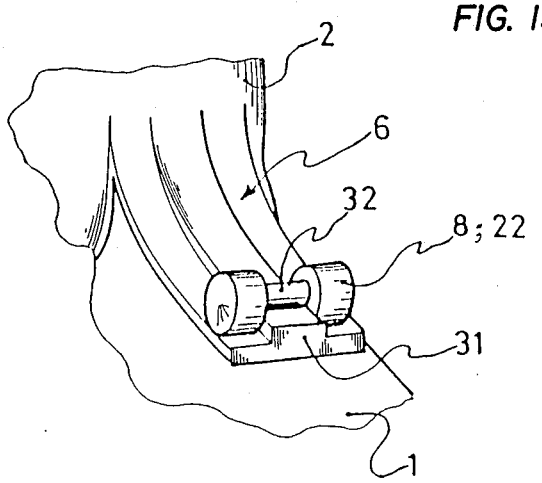
FIG. 13 illustrates another embodiment of a future modification of the construction of the elements of shock absorption apparatus according to the present invention.

Finally, pressure rollers 8 or 22 of the shock absorption apparatus described above, and the flexible blade can optionally comprise guidance means of a matching shape so as to facilitate cooperation between the rollers and the blade during their relative displacement. As shown in FIG. 12, for example, pressure rollers 8 or 22 of the shock absorption apparatus (details of which are omitted to facilitate illustration of this aspect of the invention) cooperate with flexible blade 6 by providing guide means such as groove 30 in the upper surface of the flexible blade. The width of the groove corresponds substantially to the length of the pressure roller; and this guide means is similar to a roller path. In FIG. 13, the guide means is opposite to what is shown in FIG. 12. Thus, the blade is provided with central rib 31, of a width less than the width of the blade, and the pressure roller, like that of the embodiments of FIGS. 1–5 and FIGS. 6, 7 and 9, is provided with complimentary central circumferential groove 32 which receives rib 31. The pressure roller thus overlaps guide rib 31.

Figure 14:
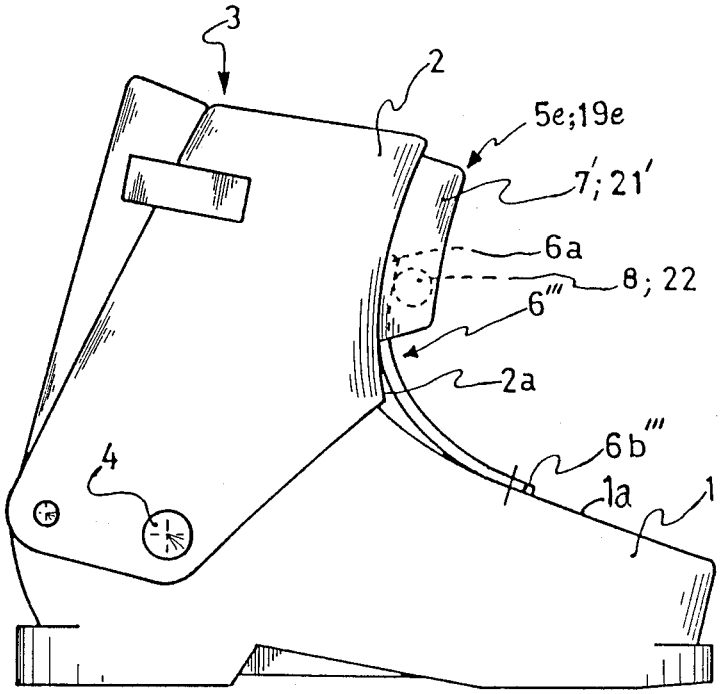
FIG. 14 is an elevation view of an alpine ski boot in which the constituent elements of the shock absorption apparatus are reversely positioned with respect to what is shown in the proceeding figure.

It is self evident that in all of the embodiments of the invention previously described, the constituent elements of the shock absorption apparatus can be reversed. Stated otherwise, as shown in FIG. 14, housing 7' of shock absorption apparatus 5E, or housing 21' of shock absorption apparatus 19E can be mounted on cuff 2 instead of shell base 1. In such case, flexible blade 6''' is attached at its front end 6*b'''* to upper surface 1*a* of shell base 1. Housings 7' or 21' are movable with the cuff; and rear end 6*a''* of flexible blade 6''' frictionally engages the front support surface 2*a* of movable cuff 2 of the upper.

Figure 15:
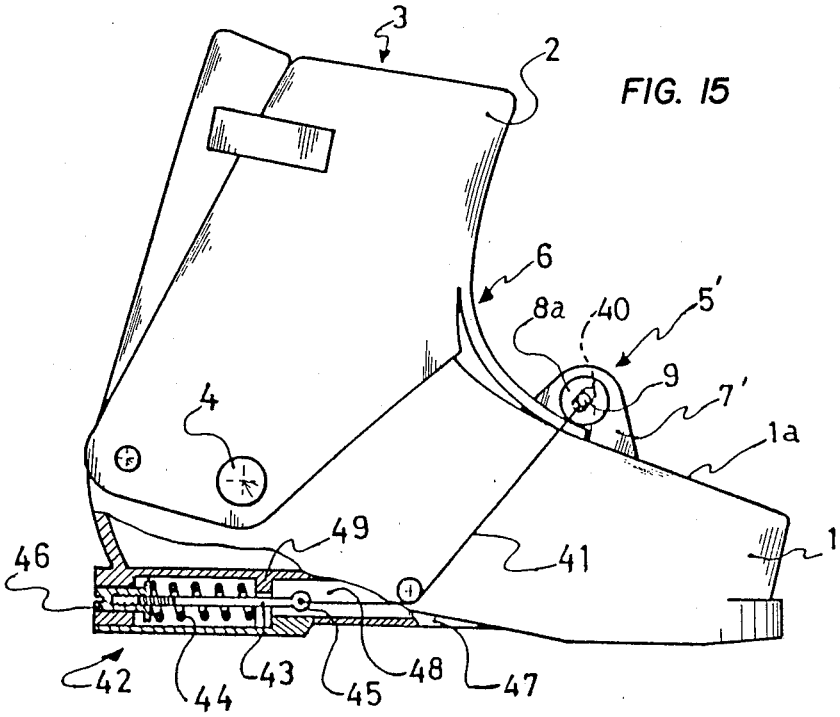
FIGS. 15 and 16 are elevation views, in cross-section, of shock absorption apparatus of still further embodiments of the shock absorption apparatus according to the present invention.
Figure 16:
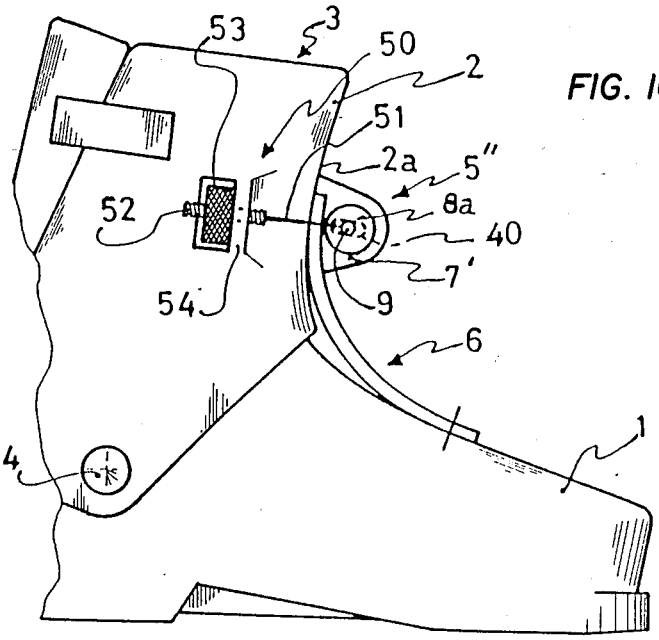

In the embodiments that follow, and specifically with reference to FIGS. 15 and 16, shock absorption apparatus 5' and 5'' eliminate the use of a ratchet wheel, but the are otherwise substantially the same as to the other components. In FIG. 15, pressure roller 8A has axel 9 slideably received in elongated slots 40 in spaced opposed walls in housing 7'. The axis of slots 40 are oriented substantially in a direction perpendicular to the tangent of the point of contact of roller 8 with blade 6.

Flexible cable 41, forming a half buckle, extends from the ends of axel 9, on both sides of shell base 1, to elastic apparatus 42 provided in opening 48 in a sleeve in sole 47 of the boot. Apparatus 42 comprises traction shaft 43 having on one end return ring 45 to which cable 41 is attached. The other end of shaft 43 is threaded into a tapped hole in bolt 46 which is free to slide in a hole in the rear end of the sleeve. Spring 44 is interposed between abutment 49 in the sleeve and bolt 46. Thus, shaft 43 is biased by spring 44 towards the rear of the boot and urges roller 8A into contact with the blade. In order to vary the contact pressure of the roller on the blade, bolt 46 can be rotated to advance or retract the threaded end of shaft 43 into the taped hole in the bolt. Optionally, roller 8A can be made of a rigid or an elastically compressible material.

In FIG. 16, flexible blade 6 is affixed to shell base 1 and pressure element 8A is associated with cuff 2 of upper 3 of the boot. Shock absorption apparatus 5'' comprises pressure roller 8A positioned on front support surface 2a of cuff 2 by means of a pair of stretcher systems 50 positioned on each side of the cuff. Each system comprises cable 51 connected on the one hand to the corresponding end of axel 9 and on the other hand, to threaded rod 52 which freely passes through shoulder 54 in the cuff. Behind shoulder 54 and engaged therewith is knurled threaded nut 53 into which rod 52 is threaded. Cable 51 is placed under predetermined pressure by selected rotation of rods 52 on either side of the cuff thus providing the desired contact pressure of the roller on the blade.

Although the invention has been described with reference to particular means, materials and embodiments, it is to be understood that the invention is not limited to the particulars disclosed and extends to all equivalents within the scope of the appended claims.

I claim:

1. An alpine ski boot having an cuff mounted on a shell base for pivotal movement about a transverse axis substantially coincident with the ankle of a skier wearing the boot, and including shock absorption apparatus for cushioning pivotal movement of the cuff with respect to the shell base during skiing in response to forward movement of the leg of the skier from an initial position, said shock absorption apparatus comprising:

(a) two elements which are respectively fixed to the cuff and to the shell base and which are engaged with each other; and (b) control means for varying the coefficient of friction between the two elements during relative displacement of the element;

(c) said control means being constructed and arranged such that the coefficient of friction during relative movement of the elements in one direction is different from the coefficient of friction during relative movement of the elements in the opposite direction.

2. An alpine ski boot according to claim 1, wherein one of said elements is a flexible blade fixed to the cuff such that a portion of the blade extends towards said shell base, and the other of said elements is a pressure member positioned in a housing fixed to the shell base, said pressure member being spaced from a support surface of the shell base for defining a narrow passage for slidable receiving the flexible blade, one side of which frictionally engages the support surface, and the other side of which frictionally engages the pressure element, and means are provided for varying the coefficient of friction between the pressure member and the flexible blade as a function of the direction of relative displacement therebetween.

3. An alpine ski boot according to claim 2, wherein the pressure member is constituted by a roller rotatably mounted on an axis that is transverse to the direction of movement of the blade, and said means for varying the coefficient of friction between the roller and the blade are constituted by means for effecting rotation of the roller only in the direction in which relative displacement of the blade takes place with respect to the roller resulting from forward movement of the cuff, said last named means blocking rotation of the roller during relative displacement of the cuff in the rearward direction.

4. An alpine ski boot according to claim 1, wherein one of said elements is a flexible blade having one end fixed to the shell base, and the other said element is a pressure member mounted in a housing fixed to the cuff, said pressure member being spaced from a support surface on the cuff for slidable receiving the other end of the blade, one side of which frictionally engages the support surface and the other side of which frictionally engages the pressure element, and means are provided for varying the coefficient of friction between the pressure member and the flexible blade as a function of the direction of relative displacement between them.

5. An alpine ski boot according to claim 4, wherein the pressure member is constituted by a roller whose axis is transverse to the direction of movement of the blade, and said means for varying the coefficient of friction between the roller and the blade are constituted by means for effecting rotation of the roller only in the direction in which relative displacement of the blade takes place with respect to the roller resulting from forward movement of the cuff, said last named means blocking rotation of the roller during relative displacement of the cuff in the rearward direction.

6. An alpine ski boot according to claim 2, wherein the roller is rotatably mounted on a lever which is itself pivotally mounted on said housing for rotation about an axis transverse to the direction of movement of the blade, the free end of said lever contacting an end of a pressure adjustment screw threaded in said housing.

7. An alpine ski boot according to claim 2, wherein the roller has opposed axial ends that are slidable mounted in slots in laterally spaced walls of said housing, said slots being elongated in a longitudinal direction oriented substantially perpendicularly to the tangent of the point of contact of the roller with the blade.

8. An alpine ski boot according to claim 3, wherein the means for effecting rotation of the roller includes a toothed ratchet wheel fixed to the roller, a pawl resiliently urged into contact with the teeth of the ratchet wheel, the engagement between the ratchet wheel and the pawl effecting rotation of the roller only during relative displacement between the blade and the roller in one direction.

9. An alpine ski boot according to claim 2, wherein the roller of the shock absorption apparatus is formed of a material which is more or less elastically compressible.

10. An alpine ski boot according to claim 2, wherein the roller is formed of a relatively rigid material.

11. An alpine ski boot according to claim 7, wherein the roller is formed of a relatively rigid material, and the shock absorption apparatus is provided with elastic means for controlling the contact pressure of the roller against the blade, said elastic means being positioned in the sole of the boot and including a cable kinematically linking the roller to a spring member.

12. An alpine ski boot according to claim 4, wherein the contact pressure of the roller against the blade is adjustable by means of a stretcher system on the cuff having flexible cable means engaged with the axis of the roller.

13. An alpine ski boot according to claim 2, wherein the pressure member is constituted by a transverse pinch-roller mounted for longitudinal translation movement in an opening in said housing, and a compression spring which urges said roller against an inclined ramp such that said spring normally pushes the pinch-roller into a pinch-position between the ramp and the blade for increasing the contact pressure of the roller on the blade.

14. An alpine ski boot according to claim 13, wherein the inclination of said ramp moves the pinch-roller against the blade during displacement of the blade relative to the cuff in only one direction.

15. An alpine ski boot according to claim 2, wherein the blade is integral with the cuff.

16. An alpine ski boot according to claim 2, wherein the blade is integral with the shell base.

17. An alpine ski boot according to claim 2, wherein the blade has a cross-section of progressively variable thickness from its corresponding end that cooperates with the pressure member.

18. An alpine ski boot according to claim 1, including guidance means for guiding reciprocal movement of the elements.

19. An alpine ski boot according to claim 18, wherein the guidance means are constituted by a groove in one element and by means on the other element fitting within the groove.

20. An alpine ski boot according to claim 19, wherein the guidance means are constituted by a longitudinal rib projecting from one element, and by means fitting over the groove on the other element.

21. An alpine ski boot having an cuff mounted on a shell base for forward and rearward pivotal movement about a transverse axis, said boot including:

(a) an element mounted on the cuff in contact with an element mounted on the shell base so that the elements move relative to each other in response to pivotal movement of the cuff relative to the shell base; and (b) control means operatively associated with the elements and responsive to relative movement between the engaged elements such that the force required to move the elements relative to each other is dependent upon the direction of pivotal movement of the cuff relative to the shell base.

22. An alpine ski boot according to claim 21 wherein said control means is further constructed and arranged so that the coefficient of friction between the elements is less during forward pivotal movement than during rearward pivotal movement.

23. An alpine ski boot according to claim 22 wherein said control means is constructed and arranged to adjust the coefficient friction.

24. An alpine ski boot according to claim 22 wherein one of the elements is a flexible blade and the other element is a pressure member mounted on said control means for frictionally contacting said blade during forward and rearward pivotal movement of the cuff on the shell base.

25. An alpine ski boot according to claim 24 wherein the flexible blade is mounted on the shell base and said control means is mounted on the cuff.

26. An alpine ski boot according to claim 24 wherein said flexible blade is mounted on the cuff and said control means is mounted on the shell base.

27. An alpine ski boot according to claim 25 wherein said pressure member is a roller engaged with said blade, and wherein said control means comprises a housing mounted on said shell base, and roller mounting means for mounting said roller on the housing.

28. An alpine ski boot according to claim 27 wherein said roller mounting means includes a lever pivotally mounted on said housing, and means for mounting said roller on said lever such that the roller rotates in one direction in response to movement of the blade when the cuff moves forwardly, and the roller is held against rotation in response to rearward movement of the cuff.

29. An alpine ski boot according to claim 28 wherein said means mounting said roller on said lever includes ratchet means constructed and arranged to effect rotation of the roller in said one direction, and to prevent rotation of the roller in the opposite direction.

30. An alpine ski boot according to claim 29 wherein said roller includes a toothed ratchet wheel mounted on said roller and a spring biased pawl on the housing engaged with the teeth of the wheel.

31. An alpine ski boot according to claim 28 wherein said roller mounting means includes manually adjustable means for adjusting the angular position of the lever on the housing thereby controlling contact pressure between the roller and the blade.

32. An alpine ski boot according to claim 28 including means for resiliently biasing the lever.

33. An alpine ski boot according to claim 21 including means for releasably biasing the lever.

34. An alpine ski boot according to claim 27 wherein said roller mounting means is constructed and arranged so that the roller rotates in response to forward movement of the blade when the cuff moves forwardly, and the roller is constrained against rotation in response to rearward movement of the blade.

35. An alpine ski boot according to claim 34 wherein said roller mounting means includes ratchet means for effecting rotation of the roller in said one direction and preventing rotation of the roller in the opposite direction.

36. An alpine ski boot according to claim 35 wherein said roller includes a toothed ratchet wheel mounted on said roller and a spring bias pawl on the housing engaged with the teeth of the wheel.

37. An alpine ski boot according to claim 36 wherein said roller mounting means includes manually adjustable means for adjusting the contact pressure between the roller and the blade.

38. An alpine ski boot according to claim 25 wherein said pressure member is a roller engaged with said blade, and wherein said control means comprising a housing mounted on said shell base, and roller mounting means for mounting said roller on the housing.

39. An alpine ski boot according to claim 28 wherein said roller mounting means is constructed and arranged so that the roller rotates in response to forward movement of the blade when the cuff moves forwardly, and the roller is constrained against rotation in response to rearward movement of the blade.

40. An alpine ski boot according to claim 39 wherein said roller mounting means includes ratchet means for effecting rotation of the roller in said one direction and for preventing rotation in the opposite direction.

41. An alpine ski boot according to claim 40 wherein said roller includes a ratchet wheel mounted on said roller and a spring biased pawl on the housing engaged with the wheel.

42. An alpine ski boot according to claim 37 wherein said roller mounting means includes manually adjustable means for adjusting the contact pressure between the roller and the blade.

43. An alpine ski boot according to claim 24 wherein said pressure member is a roller contacting the blade.

44. An alpine ski boot according to claim 43 wherein the roller is resiliently urged into contact with the blade.

45. An alpine ski boot according to claim 44 including ratchet means constructed and arranged to effect rotation of the roller in one direction in response to forward movement of the blade when the cuff moves forwardly, and to prevent rotation of the roller in the opposite direction in response to rearward movement of the cuff.

46. An alpine ski boot according to claim 43 wherein said roller is mounted on a lever whose angular position is adjustable for adjusting contact the pressure between the roller and the blade.

47. An alpine ski boot according to claim 44 wherein said roller is mounted in a housing which is constructed and arranged so that forward movement of the cuff effects rolling engagement between the roller and the blade, and rearward movement of the cuff effects sliding engagement between the roller and the blade.

48. An alpine ski boot according to claim 47, wherein said housing includes a guide cooperable with the roller for effecting longitudinal movement of the roller in the housing in the same direction that the blade moves in response to forward movement of the cuff, and cam means engageable with said roller for effecting its transverse movement in the housing in a direction transverse to that of the blade with the latter moves in response to rearward movement of the cuff.

49. An alpine ski boot according to claim 48 including means for biasing the roller towards engagement with said cam means.

50. An alpine ski boot according to claim 46 wherein said blade is attached to said shell base.

51. An alpine ski boot according to claim 46 wherein said blade is attached to the cuff.

52. An alpine ski boot according to claim 49 wherein said blade is attached to said shell base.

53. An alpine ski boot according to claim 49 wherein said blade is attached to the cuff.

54. An alpine ski boot according to claim 26 wherein said blade is separate from, but attached to, said cuff.

55. An alpine ski boot according to claim 26 wherein said blade is integral with the cuff.

56. An alpine ski boot according to claim 43 wherein one end of said blade is attached to said cuff, and the other end of the blade is free, said roller contacting said blade in a region between the ends of the blade, the thickness of said blade in said region varying along the length of the blade.

57. An alpine ski boot according to claim 56 wherein the blade is integral with the cuff.

58. An alpine ski boot according to claim 43 wherein said roller is rotatable on an axis parallel to the direction of movement of the blade as the cuff portion pivots on the shell base.

59. An alpine ski boot according to claim 58 wherein cooperable means are provided on the roller and blade for constraining movement of the blade in a direction parallel to the axis of rotation of the roller.

60. An alpine ski boot according to claim 59 wherein said cooperable means includes a longitudinal groove in said blade within which said roller fits.

61. An alpine ski boot according to claim 59 wherein said cooperable means includes a longitudinal rib on said blade and a circumferential groove in said roller into which said rib fits.

62. An alpine ski boot according to claim 43 including means mounting said roller for limited displacement in a direction normal to the blade.

63. An alpine ski boot according to claim 62 including resilient means for biasing said roller in said normal direction into contact with said blade.

64. An alpine ski boot according to claim 63 including manually operable means operatively associated with said resilient means for adjusting the normal force between the roller and the blade.

65. An alpine ski boot according to claim 64 wherein said manually operable means is located on the shell base.

66. An alpine ski boot according to claim 65 wherein said blade is mounted on said cuff.

67. An alpine ski boot according to claim 65 wherein said blade is mounted on said shell base.

68. An alpine ski boot according to claim 67 wherein said manually operable means is on said cuff.

69. An alpine ski boot according to claim 44 wherein said roller is mounted on a resiliently biased lever.

* * * * *